US006609573B1

(12) United States Patent
Day

(10) Patent No.: US 6,609,573 B1
(45) Date of Patent: Aug. 26, 2003

(54) METHOD AND APPARATUS FOR A HORIZONTAL PIPE HANDLING SYSTEM ON A SELF-ELEVATING JACK-UP DRILLING UNIT

(75) Inventor: Howard W F Day, Madisonville, LA (US)

(73) Assignee: Friede & Goldman, Ltd., Houston, TX (US)

( * ) Notice: Subject to any disclaimer, the term of this patent is extended or adjusted under 35 U.S.C. 154(b) by 0 days.

(21) Appl. No.: 09/449,294

(22) Filed: Nov. 24, 1999

(51) Int. Cl.[7] ..... E21B 15/02; E21B 19/18; E21B 19/20

(52) U.S. Cl. ..... 166/380; 166/77.51; 175/9; 175/85; 414/22.54; 414/22.62; 414/22.63

(58) Field of Search ..... 166/75.14, 77.51, 166/85.1, 85.5, 380; 175/9, 85, 161; 414/22.51, 22.52, 22.54, 22.57, 22.55, 22.59, 22.62, 22.63

(56) References Cited

U.S. PATENT DOCUMENTS

| | | | | | |
|---|---|---|---|---|---|
| 3,575,005 | A | * | 4/1971 | Sumner | 175/7 |
| 3,633,771 | A | * | 1/1972 | Woolslayer et al. | 175/85 |
| 3,655,071 | A | * | 4/1972 | Langowski et al. | 214/2.5 |
| 3,702,640 | A | * | 11/1972 | Cintract et al. | 175/85 |
| 3,792,783 | A | * | 2/1974 | Brown | 414/22.62 |
| 3,795,326 | A | * | 3/1974 | Neilson et al. | 414/22.58 |
| 3,799,364 | A | * | 3/1974 | Kelly et al. | 414/22.71 |
| 3,865,256 | A | * | 2/1975 | Freeman, Sr. | 414/22.54 |
| 3,877,583 | A | * | 4/1975 | Bokenkamp | 414/22.54 |
| 4,081,087 | A | * | 3/1978 | Freeman, Sr. | 414/22.52 |
| 4,129,221 | A | * | 12/1978 | Moller | 414/22.57 |
| 4,269,542 | A | * | 5/1981 | Mueller | 175/9 |
| 4,347,029 | A | * | 8/1982 | Latimer et al. | 414/22.58 |
| 4,483,644 | A | * | 11/1984 | Johnson | 405/201 |
| 4,582,133 | A | * | 4/1986 | Tambs | 166/77.51 |
| 4,586,572 | A | * | 5/1986 | Myers et al. | 175/85 |
| 4,610,315 | A | * | 9/1986 | Koga et al. | 175/85 |
| 4,834,604 | A | * | 5/1989 | Brittain et al. | 175/85 |
| 5,458,454 | A | * | 10/1995 | Sorokan | 414/800 |
| 5,647,443 | A | * | 7/1997 | Broeder | 175/5 |

FOREIGN PATENT DOCUMENTS

| | | | | |
|---|---|---|---|---|
| GB | 2137261 | A | * 10/1984 | E21B/19/15 |

* cited by examiner

*Primary Examiner*—David Bagnell
*Assistant Examiner*—Jennifer H Gay
(74) *Attorney, Agent, or Firm*—Keaty Professional Law Corporation

(57) ABSTRACT

A pipe handling system is designed for use on an offshore structure, particularly an offshore structure provided with a cantilevered drill floor. The pipe handling system allows to handle significantly longer sections of tubulars, up to 100 feet, if necessary. The pipe handling system transports the pipes from a horizontal pipe rack adjacent to a drill floor to a vertical orientation in a set-back area of the drill floor where the drill string or casing is made up for lowering down hole. The cantilevered drill floor allows to save valuable platform space, while not significantly increasing the cost of the drilling rig. The pipe handling system, while increasing the length of handled tubulars, reduces the number of joints for making of a drill string, thereby significantly reducing the cost of pipe handling operations.

21 Claims, 9 Drawing Sheets

METHOD AND APPARATUS FOR A HORIZONTAL PIPE HANDLING SYSTEM ON A SELF-ELEVATING JACK-UP DRILLING UNIT

BACKGROUND OF THE INVENTION

This invention relates to pipe handling equipment, and more particularly to a system for handling pipes and moving them between a horizontal position and a vertical position for such exploration and production operations as, for example, incorporating the tubulars in a drill string.

Conventionally, large lengths of pipe are incorporated into a drill string for oil or gas exploration operations. In the past, the drilling industry utilized single lengths of pipe that are joined together by threads or other similar techniques for lowering down hole as a drilling operation progresses. In time, the depths at which the zone of interest are reached have significantly increased and an entire new industry, offshore oil and gas development has emerged in addition to land oil and gas explorations.

The new offshore drill units, by necessity, utilize longer drill strings for reaching subterranean formations of a pay zone. The evolution of the drilling industry led to the development of the ability to rack back doubles, which are two 30' joints of drill pipe connected together and stood back in the derrick vertically. Later, triples, that is three 30' joints, have been developed and now the length is "fourbles" of range 2 (four 30' joints) or triples of range 3 drill pipe (40' joints ) that make up a 120' stand of a drill pipe length.

In offshore oil and gas exploration, the drill string is lowered through the body of water to the bottom to a desired depth for reaching a pay zone. If the particular location does not pay off, the drilling unit is usually moved to another location. Conventional jack-up designs have dictated that the drill string be laid down in order to facilitate the rig move or other operational requirement. Naturally, the fewer joints that need to be made up and then broken, the more efficient the operation of the rig becomes.

Any time that a length of pipe can be handled in longer sections, for example in 90' lengths, as opposed to the traditional 30' or 40' lengths, pipe handling efficiency is dramatically improved.

Conventional jack-up units and bottom supported mobile offshore drilling units (MODU) relied on pipe handling systems capable of accommodating 30' or 40' lengths pipe sections.

The present invention contemplates elimination of drawbacks associated with the prior art and provision of a pipe handling system capable of handling 90' and greater length joints of drill pipe, tubing, casing, and other tubulars.

SUMMARY OF THE INVENTION

It is, therefore, an object of the present invention to provide a pipe handling system capable of accommodating 90' and longer joints of tubulars both on land and offshore.

It is another object of the present invention, to provide horizontal pipe handling system that can be placed for operation on a mobile offshore drilling unit for handling triples of range 2, doubles in range 3 or longer single joints of drill pipes, casings, and other tubulars.

It is a further object of the present invention to provide a pipe handling system that can significantly lower the overall well bore construction costs and result in capital equipment cost savings.

It is another object of the present invention to provide an offshore drilling unit having a cantilevered drill floor for conducting oil and gas exploration production operations equipped with a pipe handling system for moving tubulars from a horizontal pipe rack to a vertical set-back area.

It is still a further object of the present invention to provide a method of handling tubulars in an offshore platform environment.

These and other objects of the present invention are achieved through a provision of a pipe handling system that transports pipes stored in a horizontal location adjacent to a drill floor to a cantilevered drill floor, wherein the pipe stands are set in a vertical orientation in a set-back area. The pipe handling system includes lifting means, such as a crane, an optional feeding conveyor and a vertical lifting mechanism for picking up the pipe and carrying it to a vertical position in the set-back area. By utilizing the drill floor that is extended away from the platform surface proper, greater surface facilities can be utilized for useful offshore operations.

In the method of pipe handling at an offshore rig, which can be applicable also to onshore facilities, a pipe rack is provided adjacent to the derrick and the drill floor. A crane, for example an articulated crane, lifts horizontally stored pipes from the pipe rack and carries them toward the drill floor, wherein a pipe stand or casing is picked up by a vertical lifting mechanism. The pipe is grasped by two grasping members near the top and bottom of the pipe. The pipe is then moved, while still in the vertical orientation, toward a set-back area adjacent to the mousehole. The port and the starboard rig cranes can also present a tubular to the drill floor in a similar manner.

By allowing to vertically store the pipes, valuable work space on an offshore location can be dramatically saved. The horizontal pipe handling system allows to handle longer sections of pipes, 90' and above, if necessary, thus reducing the costs and time of forming up a drill string or casing. As a result, significant cost savings to the operator of the rig can be achieved.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
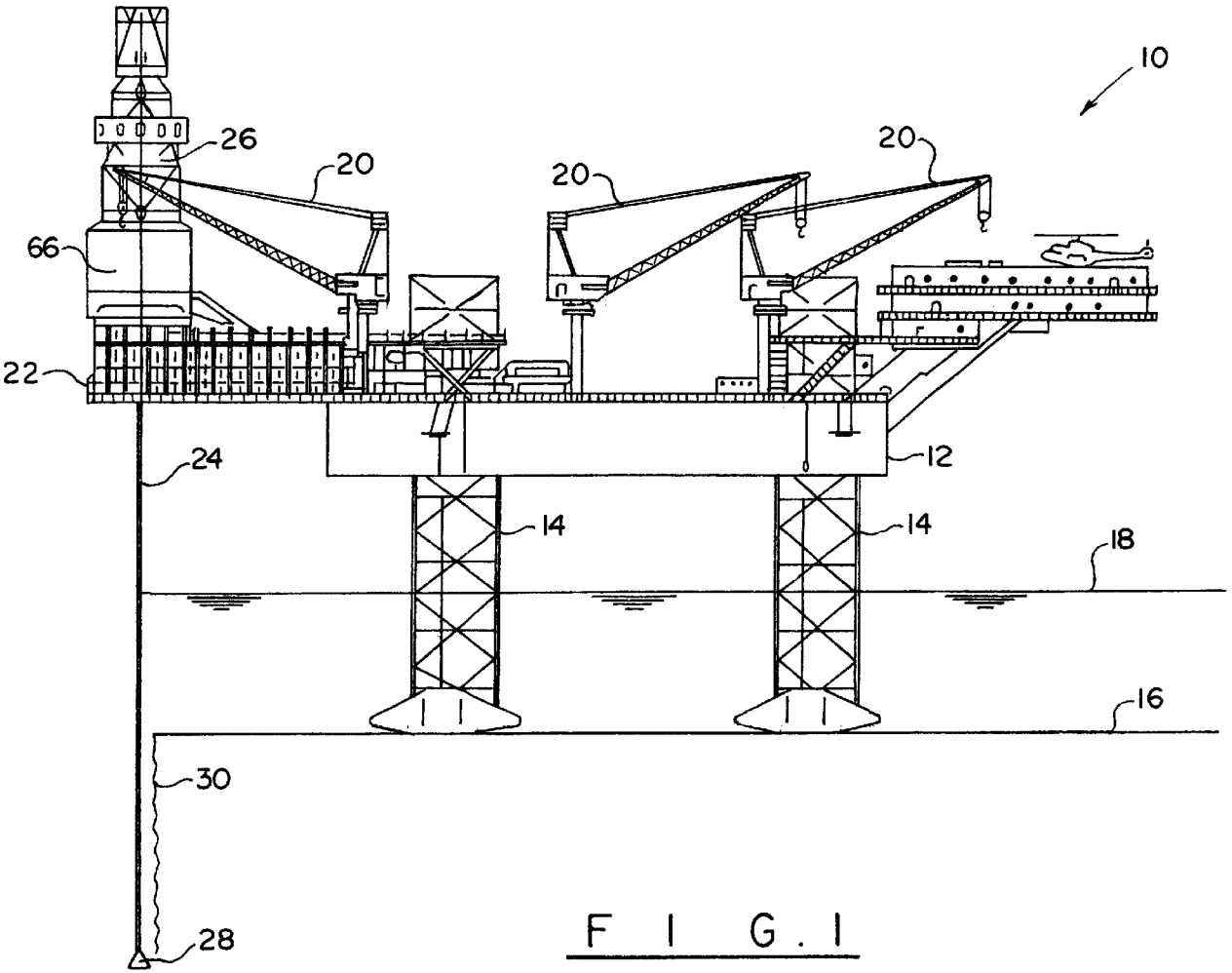
FIG. 1 is a schematic view of an offshore drilling unit with a cantilever drill floor.

Turning now to the drawings in more detail, FIG. 1 schematically illustrates an offshore drilling unit, which is designated by numeral 10 in the drawings. The offshore structure 10 comprises a platform 12 supported by a plurality of legs 14 extended to the ocean floor 16. The platform 12 is elevated by jackups or similar means above a water level 18 to a height sufficient to ensure safe operations in an offshore location. Conventionally, the height to which the platform 12 is elevated is calculated to be above the highest anticipated waves at a particular location.

The unit 10 is equipped with one or more cranes 20 mounted on the deck of the platform for handling pipes, supplies, and other necessary loads during operation of the unit 10. Of a particular advantage for the present invention is provision of a cantilevered drill portion 22 that extends outwardly from the periphery of the platform 12, with one side of the drill portion 22 being supported on the deck of the platform 12.

The cantilevered drill portion 22 extends to a distance (FIG. 1) outside of the limits of the platform 12 and allows extension of a drill string 24 downwardly from the drill floor to the required depth in a pay zone. A derrick 26 is placed on the drill portion 22 to support drilling and casing operations.

The drill string 24 is provided with a drill bit 28 at a section of the drill string that is lowered first into the bottom 16. As a result of drilling, an open hole 30 is developed; that hole is later cased to ensure the integrity of the well bore and to provide an opening for subsequent extensions of the drill string and, if necessary, production pipes.

Figure 3:
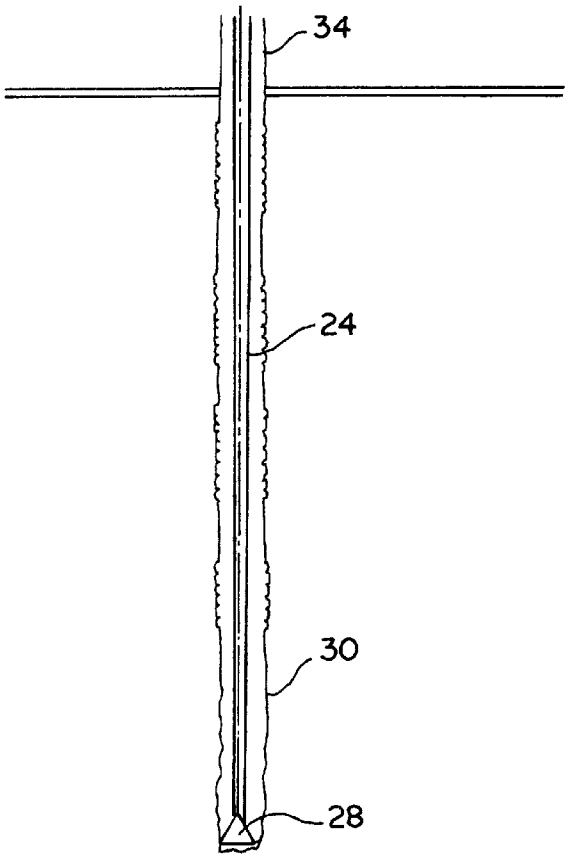
FIG. 3 is a detail schematic view showing a drill string introduced into the cased hole below the ocean floor.
Figure 2:
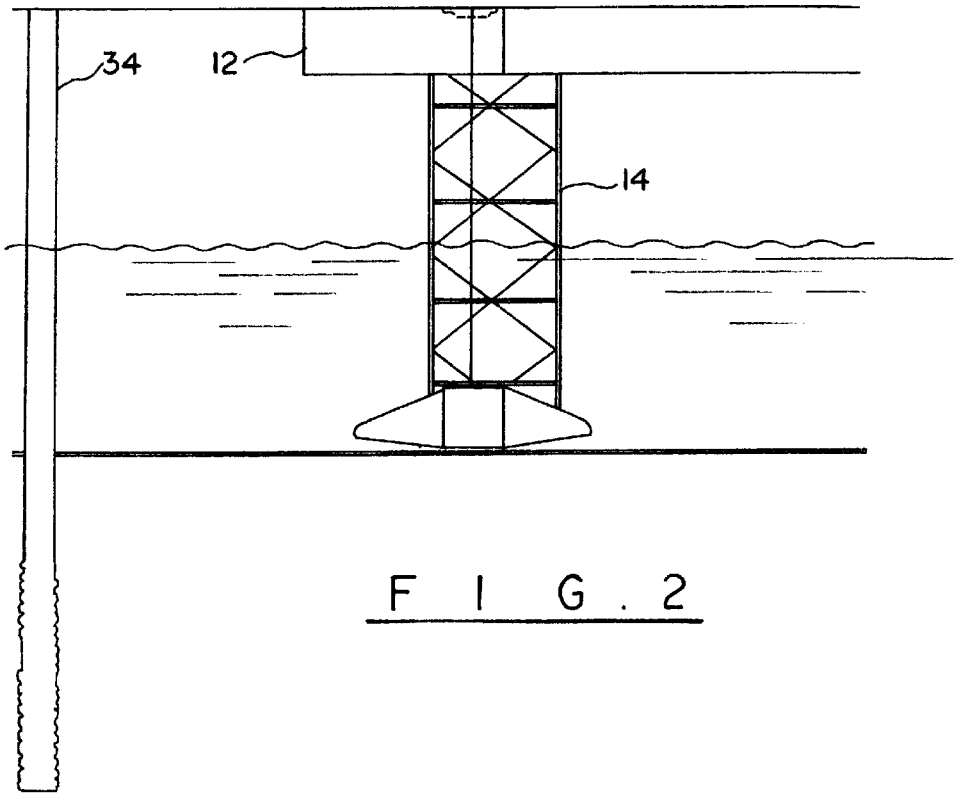
FIG. 2 is a schematic detail view of a casing string embedded into the ocean floor.

The open hole 30 is cased to prevent collapse of the walls of the well bore, and then cement slurry is pumped in an annulus between the drill string and casing wall 34 (FIGS. 2 and 3) where the slurry hardens to cement the casing in the hole. The drill string 24 is then further extended, by adding additional stands of pipe from the drill floor until the zone of interest is reached. The casing string 24 remains in place and is added in sections to continue the exploration operations.

Figure 4:
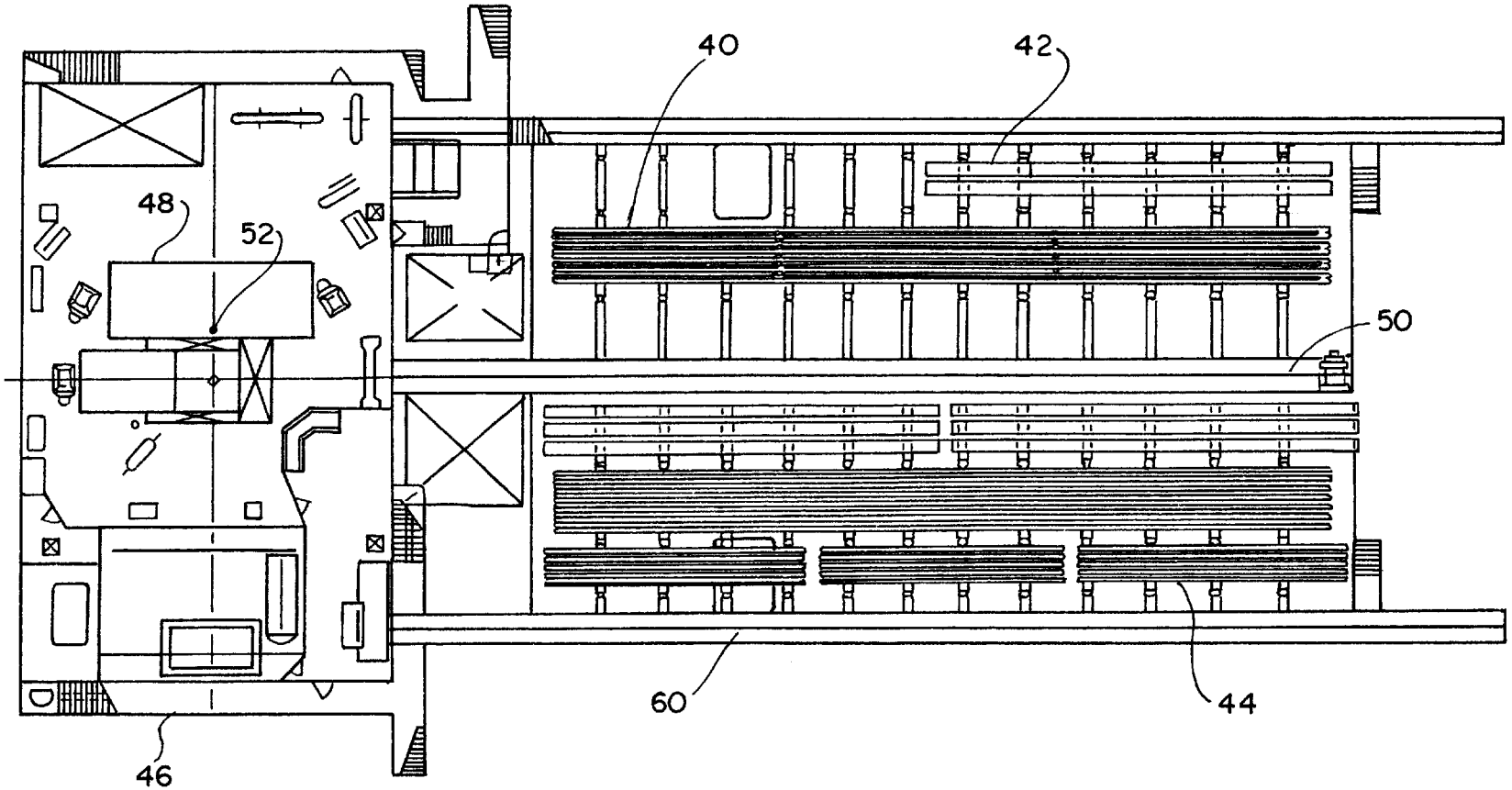
FIG. 4 is a top schematic view of the pipe handling system, as mounted in an offshore unit.
Figure 5:
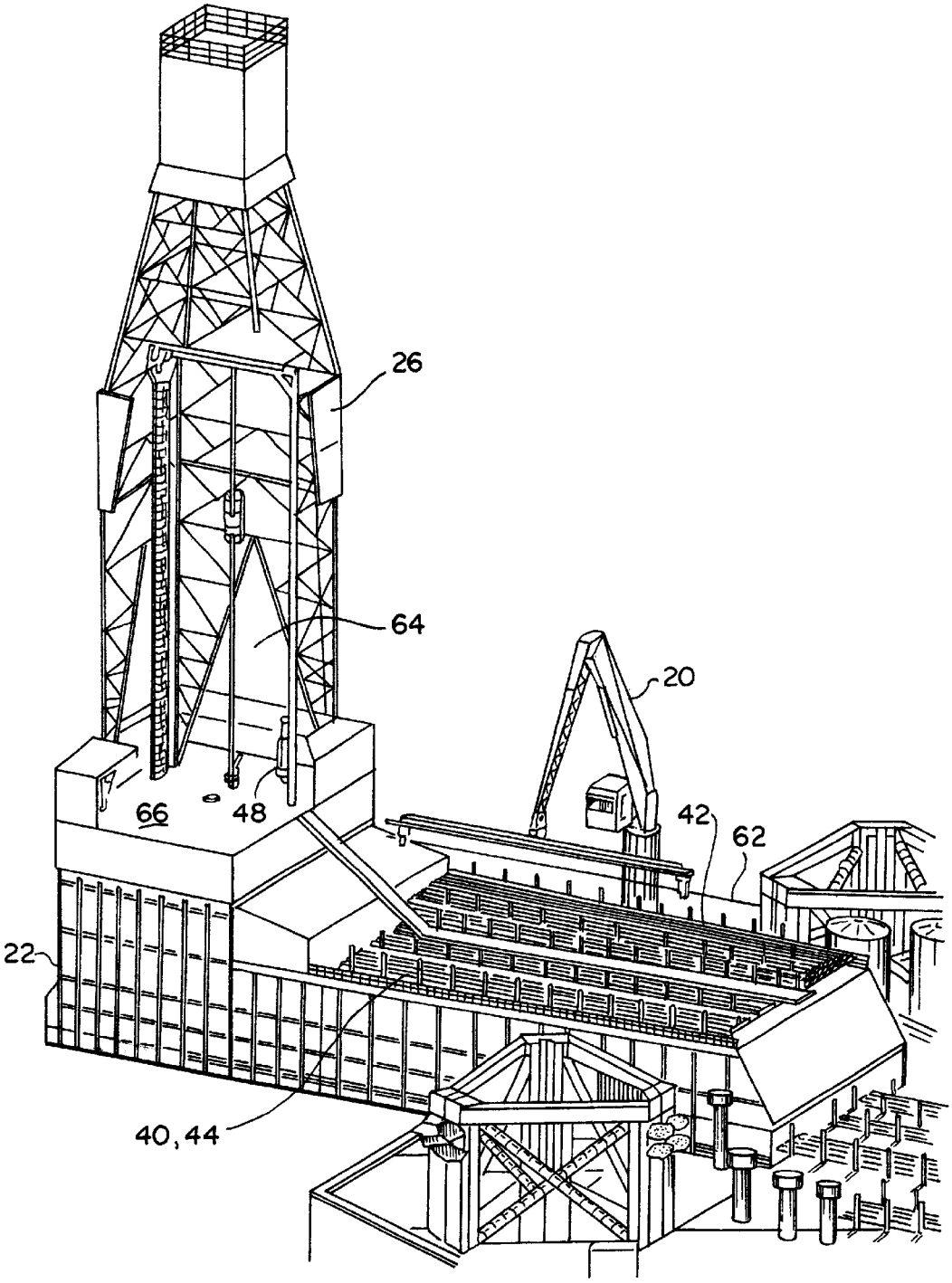
FIG. 5 is a schematic view illustrating a first step in the pipe handling operation utilizing a pipe handling crane.

The extended reach drill portion 22 accommodates an extended pipe rack 60 where sections of tubulars are stored for future use in the well bore. As shown in FIG. 4, the pipe rack 60 can be designed to accommodate stands of range 2 drill pipe 40, range 3 joints of casing 42, singles of range 2 drill pipes 44, or any combination thereof. The tubulars can be 30' and higher in length. As seen in FIG. 4, some of the tubulars are considerably longer than that, reaching up to 100 feet.

Also shown in FIG. 4 is a drill floor 46 that supports various equipment for conducting drilling and casing operations. A catwalk 50 connects the pipe rack 60 with the drill floor area 46. A mousehole 52 is provided in the set back area 48 to facilitate pipe handling.

Turning now to FIGS. 5–10, the pipe handling system and method of handling the pipes will be described in more detail. The stored tubulars 40, 42, or 44 are positioned in the pipe rack 60 in a generally horizontal position. A crane 20 picks up a length of the tubular, as designated by numeral 62 in the drawing, and moves it to a location adjacent to a V-door 64 of the derrick 26. One or more stands of drill pipe are moved at a time. For example, the crane 20 can handle three stands of drill pipe and move them toward the derrick 26, with either an articulated crane 20, or one of the rig cranes, or a bridge crane spanning the cantilever beams.

Figure 6:
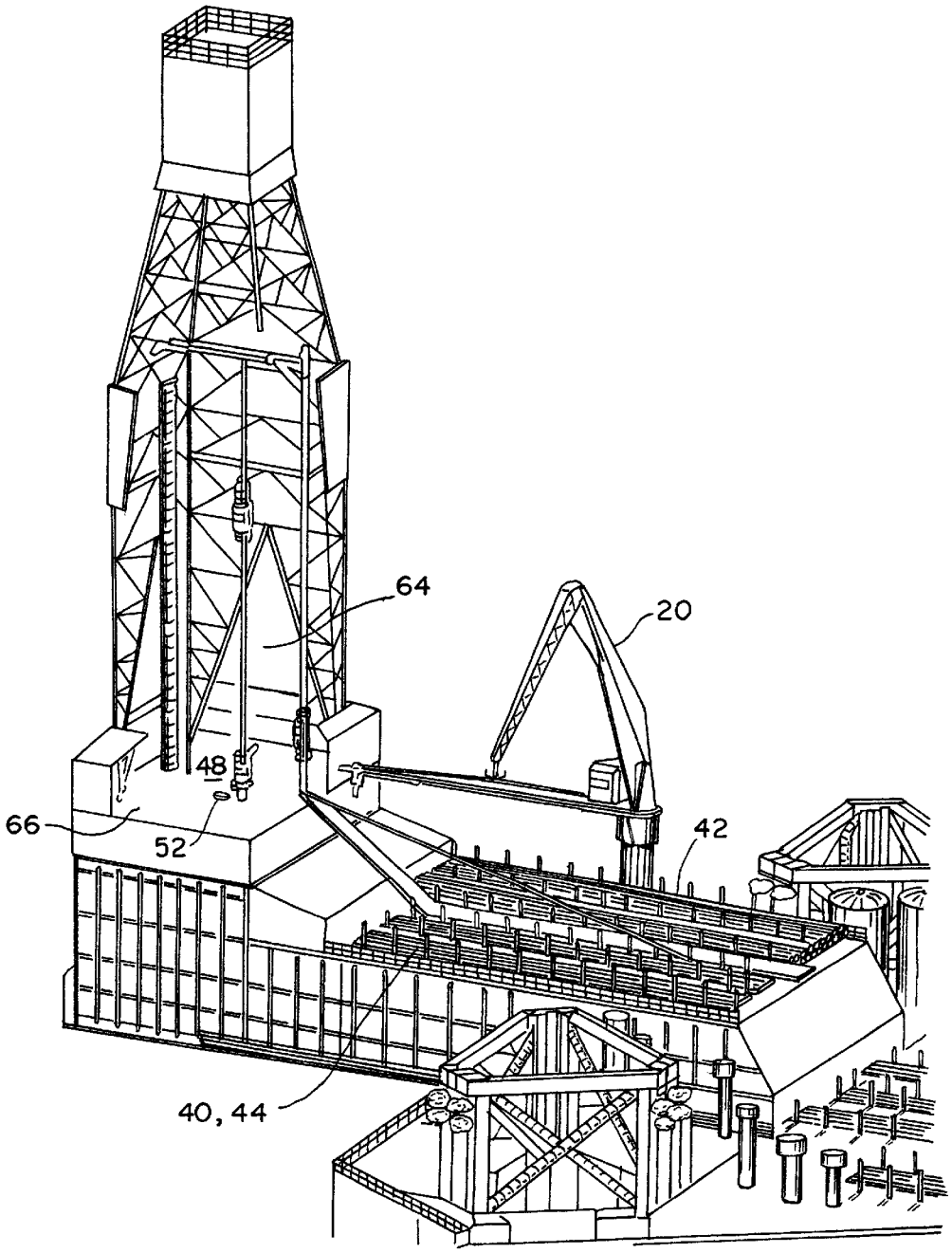
FIG. 6 is a schematic view illustrating the second step in the pipe handling process, wherein the stands of a drill string are placed in a V-door of the derrick.
Figure 7:
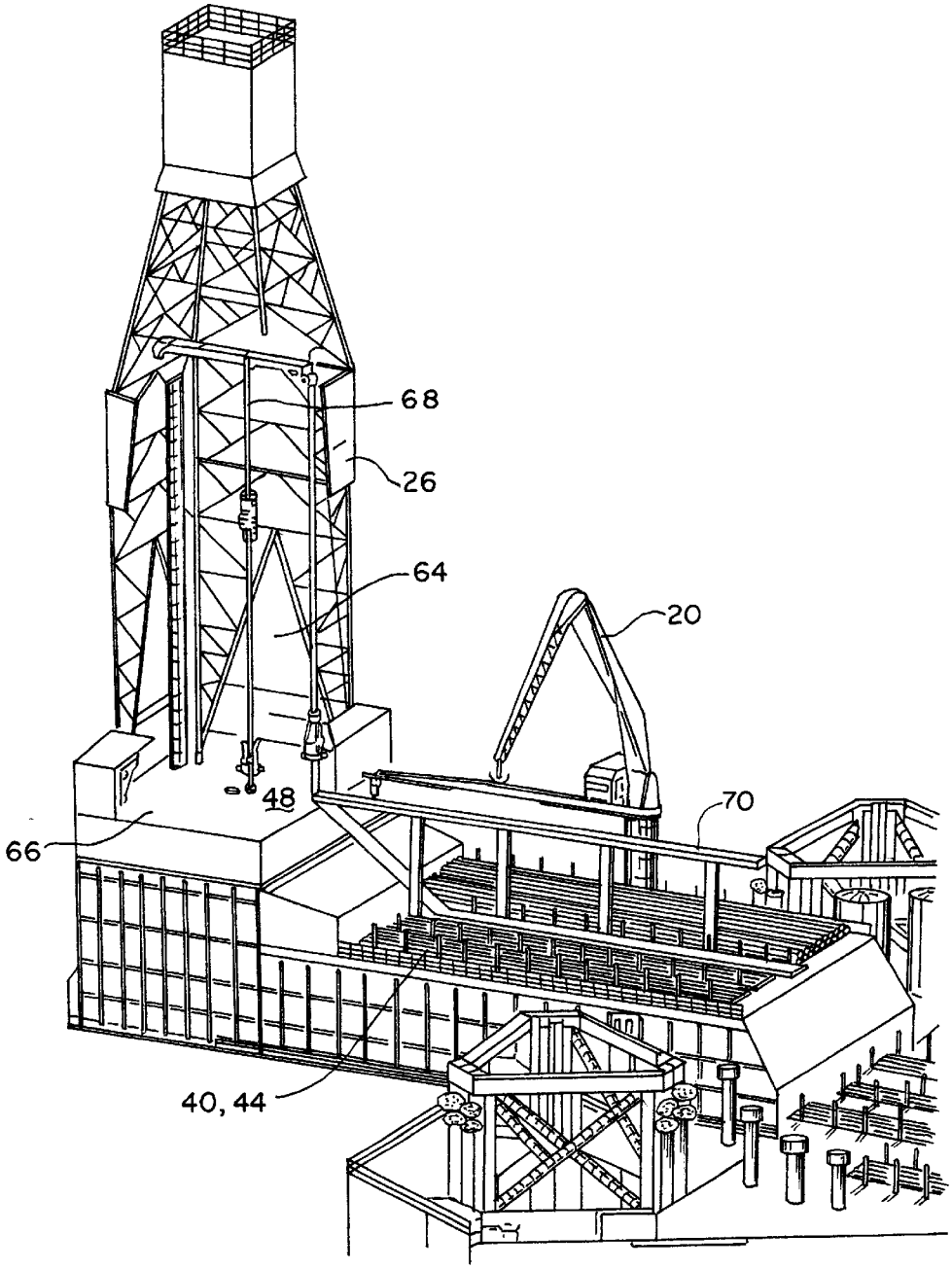
FIG. 7 is a schematic view illustrating the second step, but using an alternative, temporary holding/feeding mechanism for delivery of the stand by a conveyor.

The stands 62 are lowered to a deck, or drill floor 66 of the derrick 26 where they are picked up by a stand lifting mechanism 68. In the alternative, the stands of drill pipe may be placed in a temporary holding/feeding mechanism 70 (FIG. 7) for delivery to the lifting mechanism 68 by a conveyor or other similar mechanism. FIG. 6 illustrates the design that uses an elevated platform that forms a part of the feeding assembly to facilitate movement of the tubular from the pipe rack to the drill floor.

Figure 8:
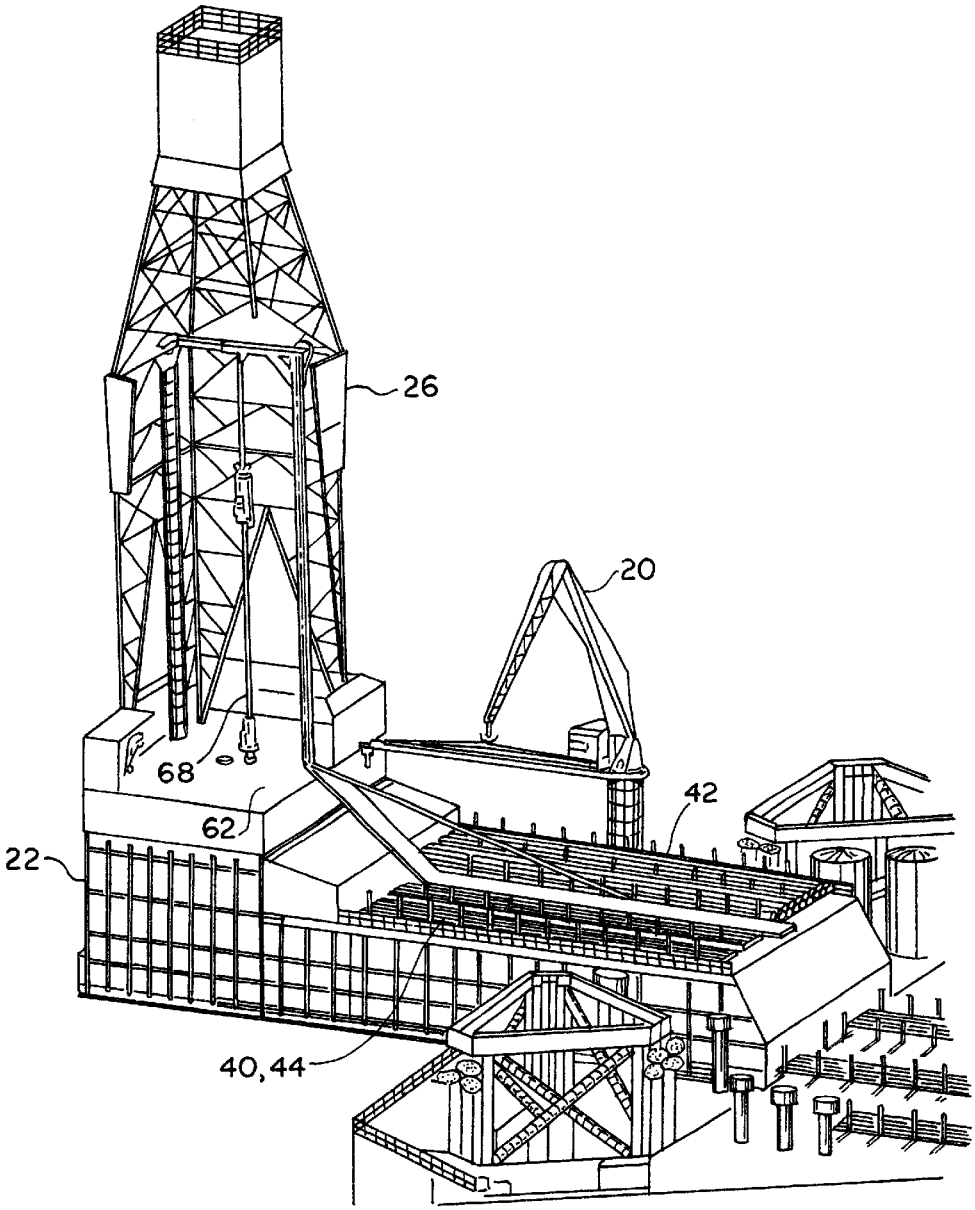
FIG. 8 is a schematic view illustrating the next step in the pipe handling process, wherein the drill stand is lifted to a vertical position.
Figure 9:
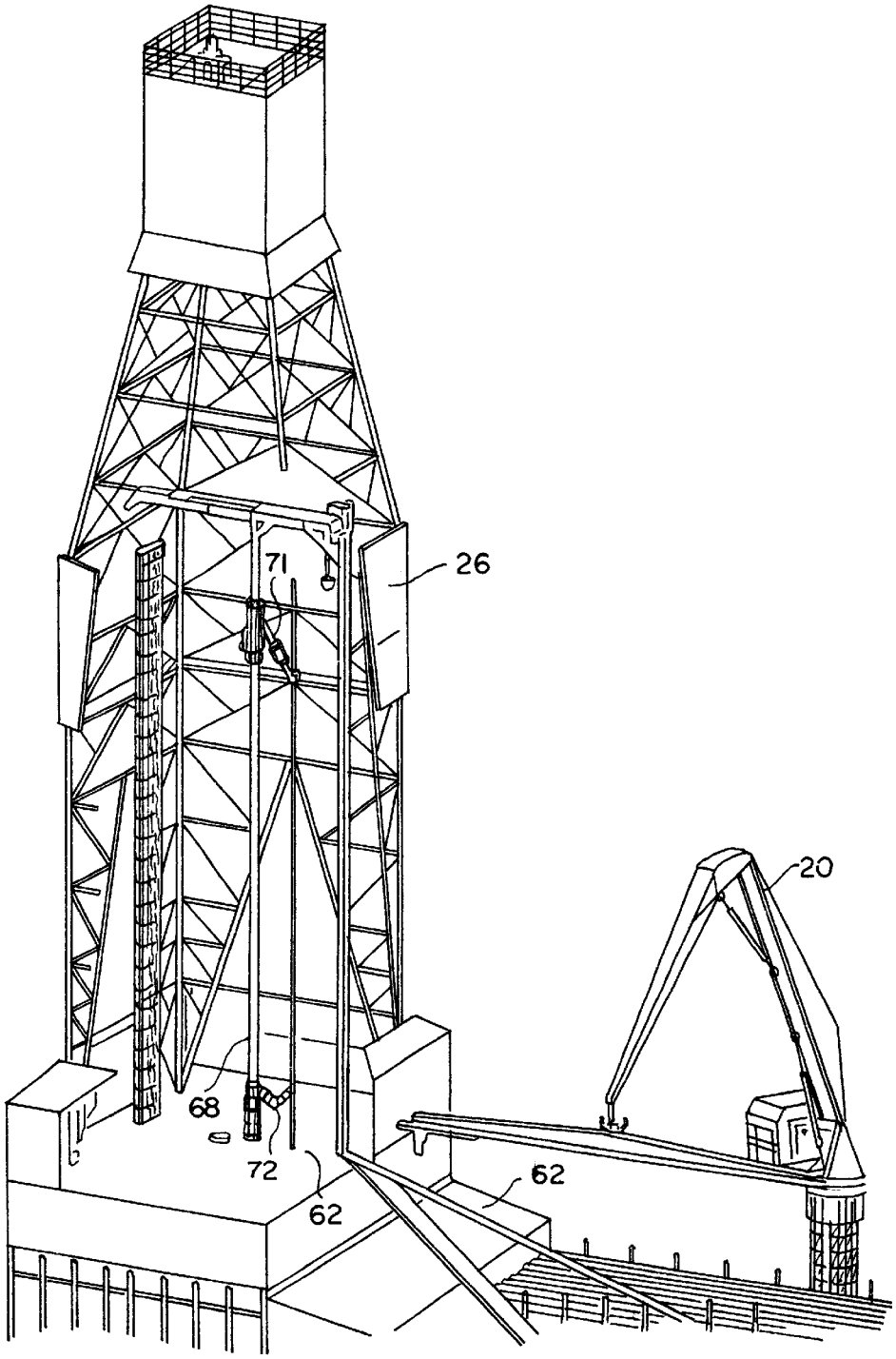
FIG. 9 is a schematic view illustrating the fourth step in the pipe handling process, wherein the section of the drill string is sent over to a vertical pipe handling mechanism.
Figure 10:
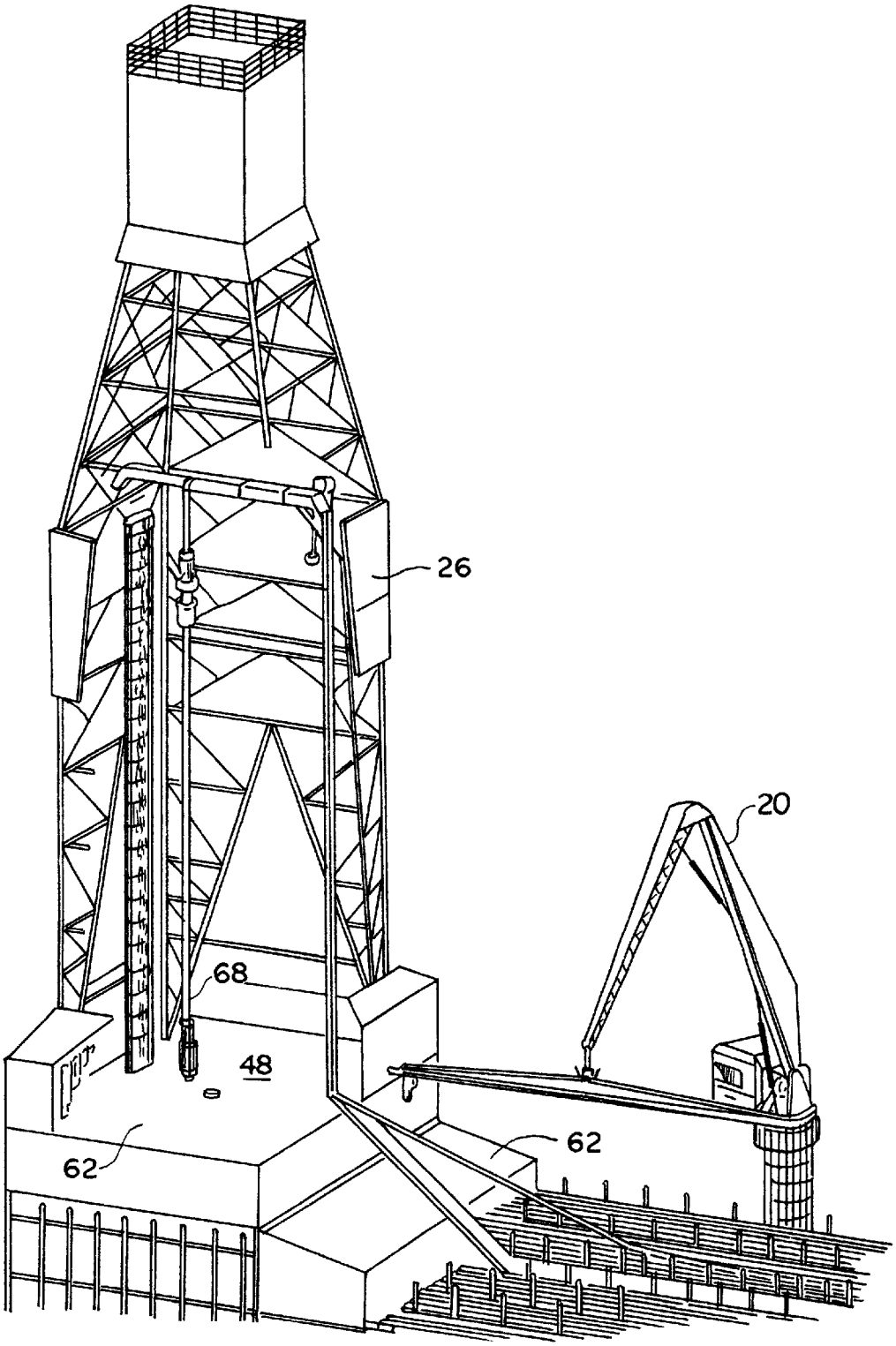
FIG. 10 is a schematic view illustrating the next step in the pipe handling process, wherein the vertical pipe handling mechanism places the stand of drill pipe into a set-back area on the derrick.

Once the drill pipe sections are placed, with one end adjacent to the stand lifting mechanism 68, the apparatus 68 lifts one stand at a time from the V-door 64 to a vertical position, as is schematically illustrated in FIG. 8. There, a single stand of the drill pipe (or other tubular) is designated by numeral 62.

The next step involves transmission of the drill pipe stand 62 to the vertical pipe lifting mechanism. The mechanism 68 has gripping jaws 71, 72 (FIG. 9) or other similar means (hoisting members) for grasping the stand 62 at vertically spaced locations while retaining the segment of pipe 62 in a generally vertical orientation. Then, the vertical pipe lifting mechanism 68 places the stand 62 into the set-back area 48 for storage until needed for drilling and/or casing operations.

The stands of the drill pipe or casing joints are then connected together in a conventional manner and lowered one by one into the open hole of the well bore until the casing depth has been reached. The casings that are conventionally handled in single range 3 (40–45 feet) in length can be easily handled as doubles by the pipe handling system of the present invention. Similarly, a single 90' joint of casing, drill pipe, tubing or any other oilfield tubular can be easily accommodated due to the provision of the cantilevered drill floor and vertical capabilities afforded by the derrick 26.

Naturally, the longer sections of stands or casing connectors require fewer joints, which saves time in completing the tubular strings, as well as provides greater overall strength to the string of drill pipe sections lowered down hole. As a result, the pipe handling efficiency is dramatically improved. Once the pipe is completed, the tool joint maintenance will be less expensive due to fewer joints in the drill string.

The system of the present invention is capable of handling triples of range 2, doubles of range 3, and longer single joints of tubing or any combination thereof, significantly reducing casing wear and decreasing the cost of explorative operations. The system of the present invention allows to change out entire strings of drill pipe or other oilfield tubular off the critical path, without lowering a single joint of pipe into the mousehole or into the well bore. This is accomplished by laying down pipes in 90-feet sections and picking them up for vertical storage in 90' sections. Additionally, the set-back area, where the horizontal surface is at a premium, becomes less occupied with pipes, and other bottom hole machinery can be placed on the derrick for greater efficiency of the operation.

The decreased set-back area would also permit making a derrick with a smaller footprint, thus further increasing the efficiency of the operation in comparison to conventional, more costly derrick designs. When the derrick footprint is smaller, the weight of the derrick, drill floor and substructure are considerably reduced which can potentially increase/the allowable hook/set-back/rotary loading combinations when the cantilever is in the extended reach mode.

The crane 20 that handles the tubulars can be an articulated crane of a conventional design or a "bridge" type crane that spans the cantilevered pipe rack. The conveyor of the feeding assembly used in the transporting step can be of a design well known to those skilled in the art.

Many changes and modifications may be made in the design of the present invention without departing from the spirit thereof. I therefore, pray that my rights to the present invention be limited only by the scope of the appended claims.

I claim:

1. An offshore structure comprising a platform, a cantilevered drill floor portion, a vertical storage area for tubular members formed on said cantilevered drill floor portion adjacent a well bore, and a system for system for handling tubular members, said system comprising:

a rack for retaining a plurality of various length tubular members in a generally horizontal position on said platform;

a lifting means for lifting at least one tubular member and lowering said at least one tubular member adjacent the vertical storage area; and a vertical lift assembly for grasping said at least one tubular member adjacent opposite ends of said at least one tubular member and moving said at least one tubular member to the vertical storage area, while retaining said at least one tubular member in a generally vertical orientation.

2. The apparatus of claim 1, wherein said lifting means is an articulated crane.

3. The apparatus of claim 1, further comprising a feeding assembly for transporting said lifted at least one tubular member towards the vertical lift assembly.

4. The apparatus of claim 3, wherein said feeding assembly comprises a horizontal conveyor assembly.

5. The apparatus of claim 3, wherein said feeding assembly comprises an elevated platform.

6. The apparatus of claim 1, wherein said vertical lift assembly is provided with a pair of vertically spaced hoisting members for secure holding of said at least one tubular member while said at least one tubular member is being moved to the vertical storage area.

7. A system for handling tubular members at an offshore structure, comprising:

a pipe rack for retaining a plurality of double and greater lengths tubular members in a generally horizontal position;

a lifting means for lifting at least one tubular member and lowering said at least one tubular member adjacent a vertical storage area;

a means for socking the vertical storage area with a plurality of tubular members at a location adjacent a well bore, said means comprising a vertical lift assembly for grasping said at least one tubular member and moving said at least one tubular member to the vertical pipe storage area, said vertical lift assembly being provided with a pair of vertically spaced ripping jaws for secure holding of said at least one tubular member adjacent opposite ends of said at least one tubular member while said at least one tubular member is being moved to the vertical storage area; and a feeding assembly with a conveyor for transporting said at least one tubular member from said lifting means to said vertical lifting assembly.

8. An offshore drilling unit, comprising:

a platform adapted for conducting drilling and production operations at a selected offshore location, said platform being supported by a plurality of leg members at a pre-determined height above wave action;

a cantilevered portion fixedly attached to said platform and having a major surface area thereof extending above water level;

a drill floor located on said cantilevered portion;

a vertical storage area for tubular members located on said drill floor on the cantilevered portion;

a pipe rack for retaining a plurality of tubular members on said platform adjacent said drill floor; and a means for moving said tubular members from said pipe rack to the vertical storage area on said drill floor, said moving means comprising a lifting means for lifting at least one tubular member from said pipe rack, a hoisting means for picking up said lifted at least one tubular member and moving it vertically to the cantilevered portion and a vertical lift assembly for grasping said at least one tubular member adjacent opposite ends of said at least one tubular member and moving said at least one tubular member to the vertical storage area while retaining said tubular members in a generally vertical orientation in said vertical storage area.

9. The apparatus of claim 8, wherein said pipe rack retains said tubular members in a generally horizontal orientation.

10. The apparatus of claim 8, wherein said moving means comprises an articulated crane.

11. The apparatus of claim 8, wherein said means for moving said tubular members further comprises a feeding assembly for transporting said at least one tubular member from said lifting means to said hoisting means.

12. The apparatus of claim 11, wherein said feeding assembly comprises a horizontal conveyor assembly.

13. The apparatus of claim 11, wherein said feeding assembly comprises an elevated platform.

14. The apparatus of claim 11, wherein said vertical lift assembly comprises a pair of grasping members for grasping said at least one tubular member and moving said at least one tubular member to the vertical storage area while retaining said at least one tubular member in a generally vertical orientation.

15. A method of moving tubular members from a horizontal storage area to a vertical storage area on a cantilevered drill floor, comprising the following steps:

providing a pipe rack for retaining a plurality of various length tubular members in a generally horizontal position;

positioning the plurality of tubular members in said pipe rack;

providing a lifting means for lifting at least one tubular member;

providing a vertical lift assembly for grasping said at least one tubular member;

lifting at least one tubular member from the pipe rack and moving said at least one tubular member towards said vertical lift assembly;

lowering said at least one tubular member adjacent said vertical lift assembly;

grasping said at least one tubular member with said vertical lifting assembly adjacent opposite ends of said at least one tubular member, while moving said at least one tubular member in a generally vertical position; and forming a vertical storage area on a cantilevered drill floor for tubular members by placing said at least one tubular member in the vertical storage area.

16. The method of claim 15, further comprising the step of providing a feeding assembly with a conveyor for transporting said at least one tubular member from said lifting means to said vertical lifting assembly.

17. The method of claim 15, wherein said lifting means comprises a crane.

18. The method of claim 15, wherein said vertical lifting assembly is provided with a pair of vertically-spaced gripping jaws for grasping said at least one tubular member while moving said at least one tubular member to the vertical storage area.

19. A method of moving tubular members on an offshore structure, comprising the following steps:

providing a platform with a cantilever portion;

forming a drill floor on said cantilever portion;

providing a pipe rack for retaining a plurality of various length tubular members in a generally horizontal position on said platform;

providing a vertical storage area for said tubular members on said drill floor;

positioning the plurality of tubular members in said pipe rack;

providing a lifting means for lifting at least one tubular member;

providing a hoisting means for hoisting said at least one tubular member and moving said at least one tubular member to a position adjacent said drill floor;

providing a vertical lift assembly for grasping said at least one tubular member at locations adjacent to opposite ends of said at least one tubular member;

lifting at least one tubular member from the pipe rack and moving said at least one tubular member towards said vertical lift assembly;

placing said at least one tubular member adjacent the vertical lift assembly; and grasping said at least one tubular member with said vertical lift assembly, while moving said at least one tubular member to the vertical storage area on said drill floor.

20. The method of claim 19, further comprising the step of providing a feeding assembly with a conveyor for transporting said at least one tubular member from said hoisting means to said vertical lift assembly.

21. The method of claim 19, further comprising the step of providing a feeding assembly with an elevated platform for transporting said at least one tubular member from said hoisting means to said vertical lift assembly.

* * * * *